US006161665A

United States Patent [19]

Hoover

[11] Patent Number: 6,161,665

[45] Date of Patent: Dec. 19, 2000

[54] UTILITY BAG

[76] Inventor: Ronald D. Hoover, 1554 O'Brien St., Baton Rouge, La. 70810

[21] Appl. No.: 09/245,257

[22] Filed: Feb. 5, 1999

[51] Int. Cl.[7] ..... A45C 3/00; A45C 7/00; A45C 13/34

[52] U.S. Cl. ..... 190/106; 190/103; 190/107; 190/125; 190/127

[58] Field of Search ..... 383/2; 150/130, 150/900; 190/103–107, 122, 124, 125, 127, 903

[56] References Cited

U.S. PATENT DOCUMENTS

| | | | |
|---|---|---|---|
| D. 280,864 | 10/1985 | Allen | D3/39 |
| D. 292,645 | 11/1987 | Young | D3/39 |
| D. 325,124 | 4/1992 | Young | D3/39 |
| D. 335,955 | 6/1993 | Omdahl | D3/39 |
| 1,618,955 | 2/1927 | Gotisar | 190/127 X |
| 1,999,064 | 4/1935 | Marks | 190/127 X |
| 2,123,454 | 7/1938 | Doppelt | 190/114 |
| 2,346,563 | 4/1944 | Doppelt | 190/122 |
| 2,428,159 | 9/1947 | Hines | 190/106 |
| 3,292,747 | 12/1966 | Dawson | 383/2 X |
| 4,301,849 | 11/1981 | Litwack et al. | 190/903 X |
| 4,312,431 | 1/1982 | Corey | 190/104 |
| 4,561,525 | 12/1985 | Shidner | 190/106 |
| 5,044,774 | 9/1991 | Bullard et al. | 383/34.1 |

*Primary Examiner*—Sue A. Weaver
*Attorney, Agent, or Firm*—Warner J. Delaune

[57] ABSTRACT

A utility bag is provided, comprising a flexible base having two opposing outer edges and two upwardly extending end panels; a pair of opposing flexible side panels attached to and extending upwardly from the opposing outer edges of the base, each of the side panels having a top edge and opposing side edges, and wherein each of the end panels of the base are attached to a lower portion of adjacent side edges of the opposing side panels; a pair of flexible upper panels attached to and extending substantially perpendicular from the top edges of the side panels, each of the upper panels including two downwardly extending end panels, wherein each of the downwardly extending end panels is attached to the end panel ofthe base and to an upper portion of an adjacent side edge of the side panels; flexible closing device, such as a zipper, cooperating between the upper panels and extending between the end panels of the base for closing and opening the bag; and wherein at least one of the side panels includes a first stiffening member attached thereto and extending between the opposing side edges, and between the outer edge of the base and a predetermined distance below the top edge. Preferably, the bag also includes at least one handle.

8 Claims, 4 Drawing Sheets

UTILITY BAG

BACKGROUND OF THE INVENTION

I. Field of the Invention

The present invention relates generally to utility bags used to contain a variety of articles, and more particularly to such bags which includes means for holding the bag in an open configuration through the use of stiffening members.

II. Prior Art

Over the years, a wide variety of utility bags have been devised to carry virtually any type of article. Many of those bags are constructed from a flexible material, such as a fabric, cloth, leather or synthetic sheet, and some include means for keeping the bag in an open configuration.

Of those bags which employ means for keeping the bag in an open configuration, this objective is often accomplished by the inclusion of curved rods sewn into the upper rim of the opening. Other such bags may include strips that resiliently bias the sides away from one another, such as the bag disclosed in U.S. Pat. No. 4,561,525. In that device, the sides are allowed to fold onto themselves when the bag is opened, while a pair of strips of heavier gauge flexile material attached to the inside of the bag act to keep the bag open.

While the aforementioned bag may achieve its stated purpose, there remains a need for a utility bag which can easily and reliably be opened and held open by virtue of its own structure, and through the folding of its sides. Ideally, such a bag would allow folding away of the sides in such a manner as to expose the entire internal surface area of the base of the bag. Furthermore, the bag should allow an upper portion of the sides to conveniently fold parallel to the lower portion of the sides, such that the open configuration of the bag is maintained by the filling of the bag with the desired articles. In this manner, the user has easy access to the entire contents of the bag without having to push away the sides. As will be seen in the descriptions provided herein, such a bag is particularly useful for holding vertically oriented, relatively flat plastic bags, such as those designed to hold plastic worms used by fisherman. However, it will become apparent that the construction of the present invention and its corresponding unique features may also be used in a wide range of situations, such as a cosmetic bag, shaving kit, and other diverse applications.

SUMMARY OF THE INVENTION

It is therefore an object of the present invention to provide a utility bag having means for keeping the bag in an open configuration.

It is also an object ofthe present invention to provide a utility bag which includes stiffening members for helping the bag to retain its shape and assist in keeping the bag in an open configuration.

It is a further object of the present invention to provide a utility bag which allows two opposing sides to fold over onto themselves wherein the upper portion of the side resides parallel to the lower portion of the side.

Still another object of the present invention is to provide a utility bag which, when open, exposes the entire internal surface area of the base of the bag.

These and other objects and advantages of the present invention will no doubt become apparent to those skilled in the art after having read the following description of the preferred embodiment which are contained in and illustrated by the various drawing figures.

Therefore, in a preferred embodiment, a utility bag is provided, comprising a flexible base having two opposing outer edges and two upwardly extending end panels; a pair ofopposing flexible side panels attached to and extending upwardly from the opposing outer edges of the base, each of the side panels having a top edge and opposing side edges, and wherein each of the end panels of the base are attached to a lower portion of adjacent side edges of the opposing side panels; a pair of flexible upper panels attached to and extending substantially perpendicular from the top edges ofthe side panels, each ofthe upper panels including two downwardly extending end panels, wherein each of the downwardly extending end panels is attached to the end panel of the base and to an upper portion of an adjacent side edge of the side panels; flexible closing means, such as a zipper, cooperating between the upper panels and extending between the end panels of the base for closing and opening the bag; and wherein at least one of the side panels includes a first stiffening member attached thereto and extending between the opposing side edges, and between the outer edge of the base and a predetermined distance below the top edge. Preferably, the bag also includes at least one handle.

More preferably, the predetermined distance is equal to approximately half the distance between the outer edge of the base and the top edge. Also, it is desirable for each of the side panels to include a first stiffening member. In a further preferred embodiment, each of the side panels includes a second stiffening member attached thereto and positioned above the first stiffening member, such that a flexible hinge is established between the first and second stiffening members.

In all of the above embodiments, the side panels are preferably constructed from two layers of material, and wherein the first and/or second stiffening member is enclosed therebetween.

DETAILED DESCRIPTION OF THE PREFERRED EMBODIMENTS

Figure 1:
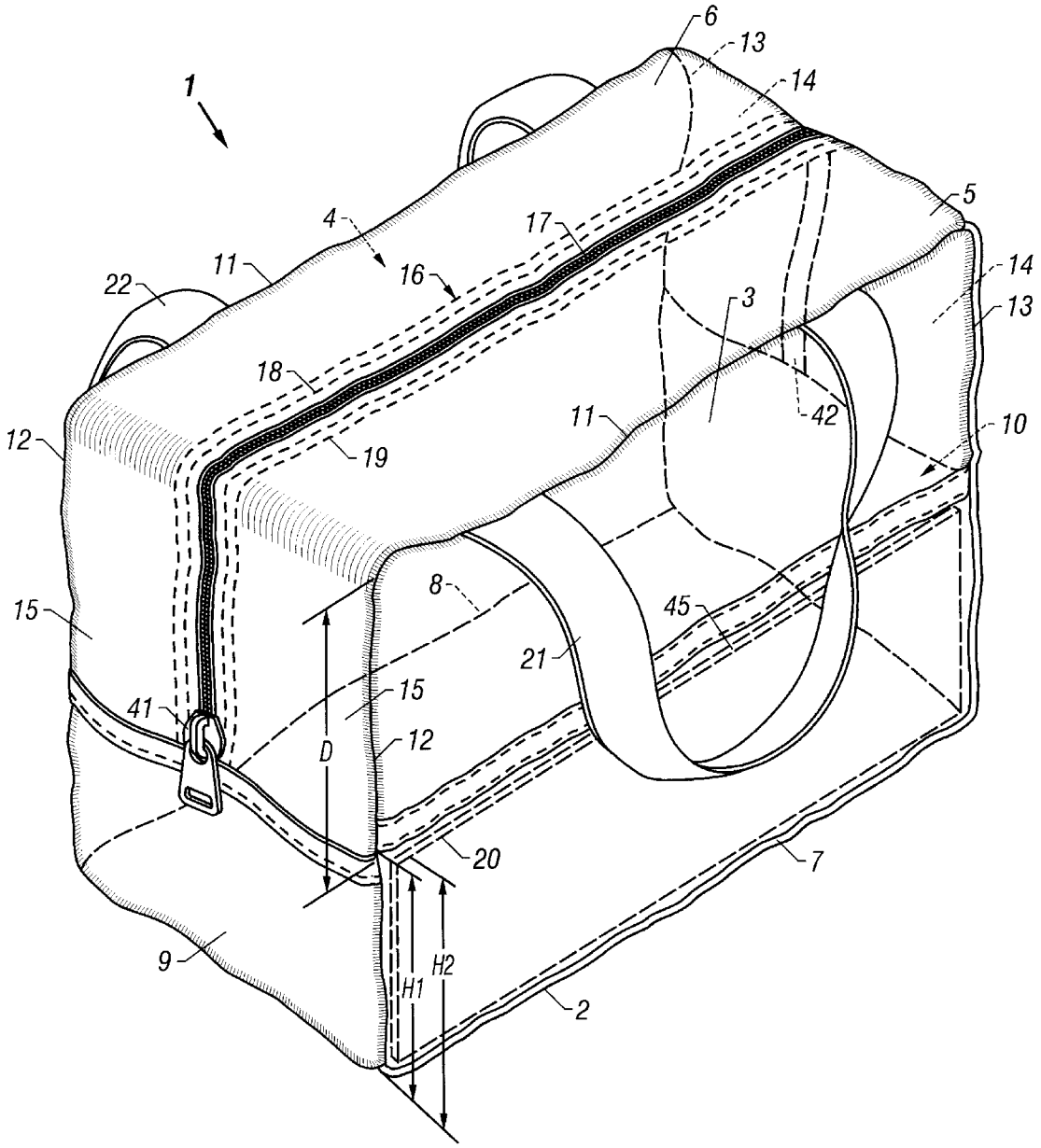
FIG. 1 is a perspective view of a preferred embodiment of the invention in a closed configuration depicting the major structural components thereof.

Turning now to FIG. 1, a preferred embodiment 1 of the present invention is shown to be generally rectangular in shape in all dimensions, comprising a base 2, opposing side panels 3,4, and upper panels 5,6. Unless otherwise noted, the external components of the bag exposed to the elements are preferably constructed from a flexible, synthetic fabric, such as nylon or the product marketed under the tradename Cordura® by DuPont de Nemours and Company. Although not strictly required, it is desirable that the fabric for those external components, such as outer layer 25, be of about 1000 denier weave, whereas any internal lining fabric, such as inner layer 26, be constructed from ripstock nylon of about 200 denier weave. Furthermore, all components are attached to one another preferably by stitching, unless otherwise indicated.

Base 2 is essentially flat and includes two opposing outer edges 7,8, and two upwardly extending end panels 9,10. Side panels 3,4 are attached to and extend upwardly from outer edges 7,8 of base 2. Each of the side panels 3,4 include a top edge 11 and opposing side edges 12,13, wherein each of the end panels 9,10 are attached to a lower portion of adjacent side edges 12,13 of the side panels 3,4, forming a preliminary four-walled enclosure.

Upper panels 5,6 are attached to and extend substantially perpendicular from the top edges 11 ofthe side panels 3,4, wherein each ofthe upper panels 5,6 including two downwardly extending end panels 14,15. Each of the end panels 14,15 is attached to the end panels 10,9, respectively of the base 2 and to an upper portion of an adjacent side edge 13,12, respectively, of the side panels 3,4. The aforementioned components, when attached to one another, create an enclosure having an opening running along the meeting edges of upper panels 5,6.

Figure 3:
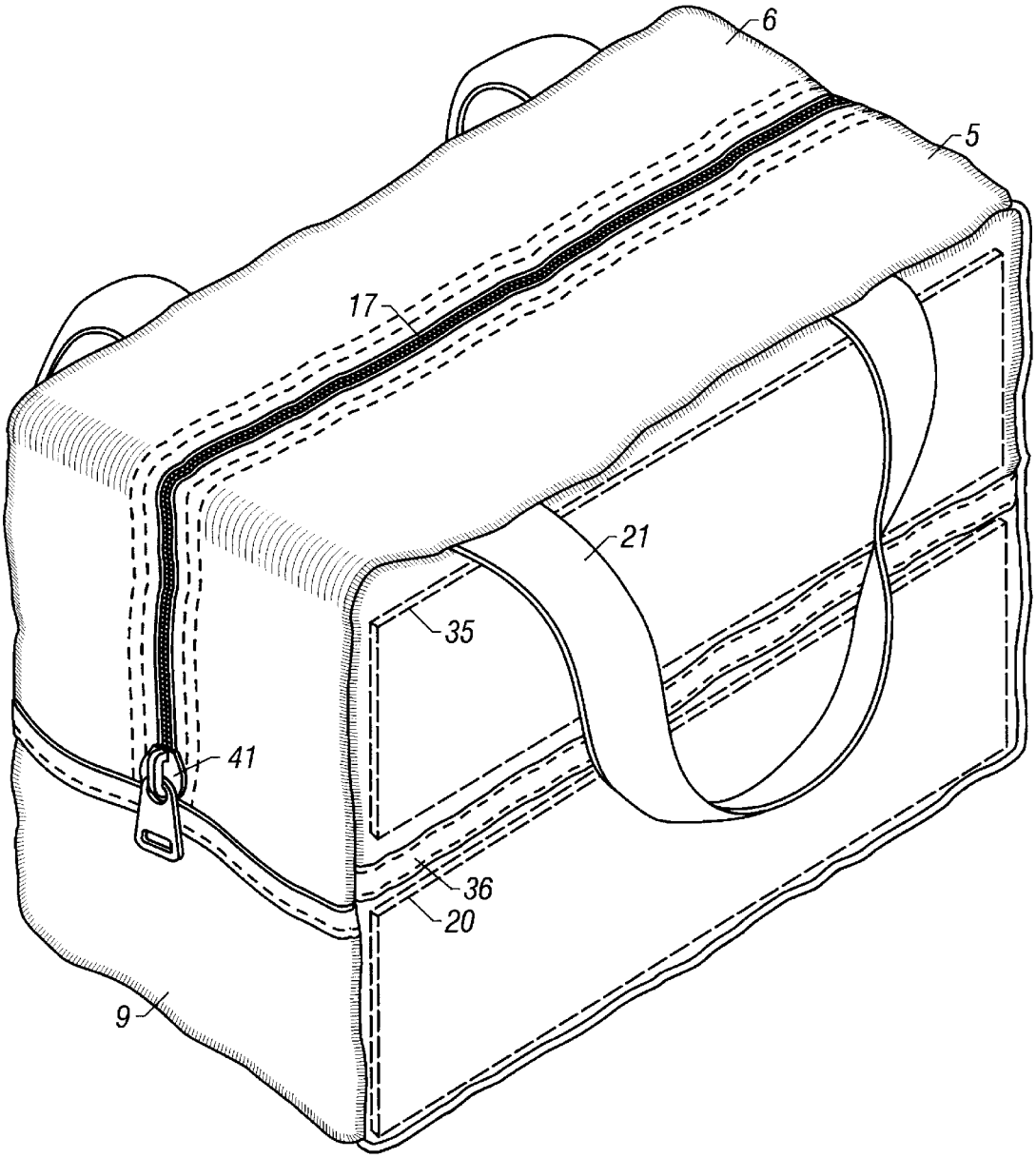
FIG. 3 is a perspective view of a preferred embodiment of the invention wherein the side panels have two stiffening members.

To open and close the bag, flexible closing means 16 extends between end panels 9,10 allowing closing and opening cooperation between upper panels 5,6. Although several means of closing the bag may be suitable, a conventional zipper 17 is preferred, as shown in FIGS. 1 and 3 stitched to upper panels 5,6 at lines 18,19. Convenient handles 21,22 are also provided which extend from side panels 3,4 for carrying the bag.

Figure 4:
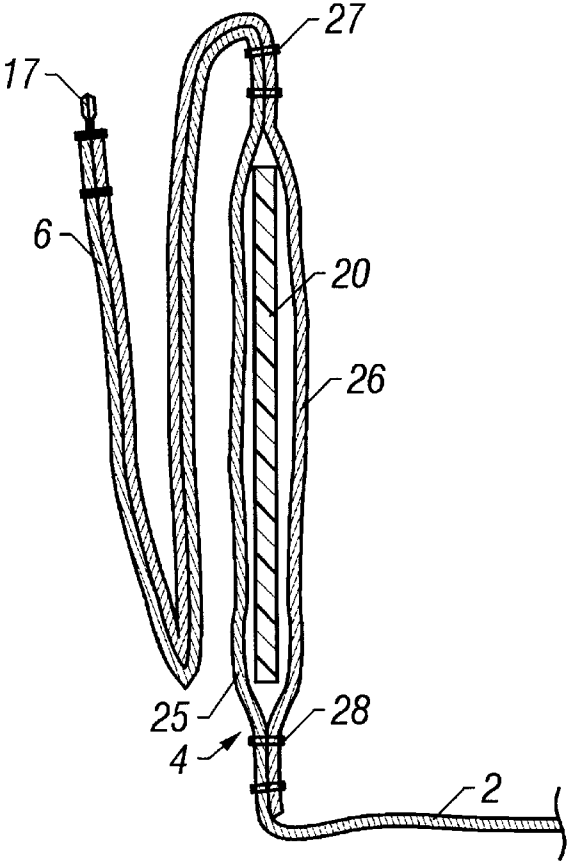
FIG. 4 is a partial cross-sectional view of the embodiment of FIG. 1 wherein the side panels have a single stiffening member.

Although only one side panel 3 is depicted in FIGS. 1 and 3, each of the side panels 3,4 further includes a first stiffening member 20 attached thereto and extending laterally between the opposing side edges 12,13. Stiffening member 20 also extends vertically from the outer edge 7,8 of the base 2 to a predetermined distance D below the top edge 11 of the side panels 3,4. For the purposes herein, the predetermined distance D is preferably equal to approximately halfthe distance between the outer edge 7,8 of the base 2 and the top edge 11 of the side panels 3,4. Stiffening member 20 is preferably constructed from a plastic sheet or other material having a stiffness sufficient to prevent collapse of the side panels 3,4 between the side edges 12,13. Also, in a preferred embodiment, each of the side panels 3,4 is constructed from two layers of material, e.g. an outer layer 25 and an inner layer 26 sewn together at points 27,28, wherein the stiffening member 20 is enclosed snugly therebetween, as shown more clearly in FIG. 4.

Figure 2:
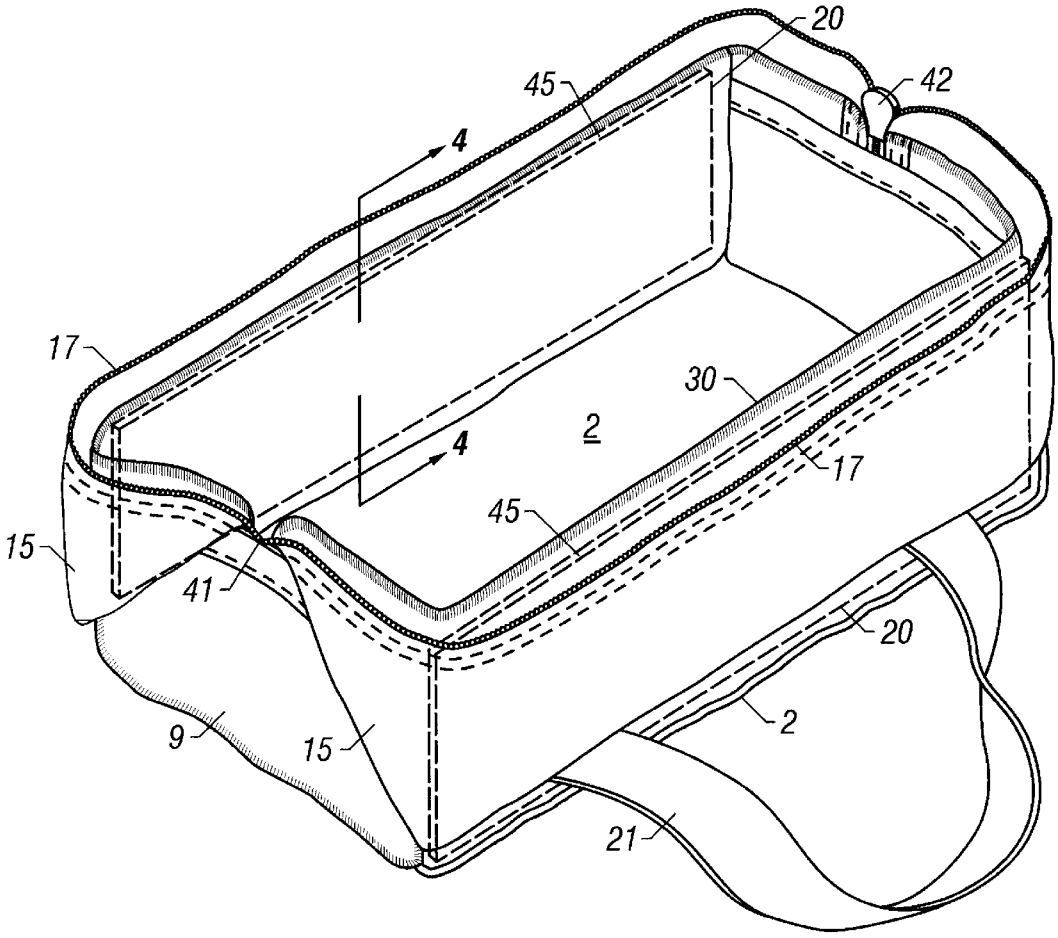
FIG. 2 is a perspective view of the embodiment of FIG. 1 depicting the invention in an open configuration.

FIG. 2 depicts the embodiment of FIG. 1 in an open configuration. As can be seen, when the side panels 3,4 are folded over themselves along a line 30 adjacent to the upper edge 45 of stiffening member 20, the bag is held in an open configuration while the upper portions of side panels 3,4 reside substantially parallel to the stiffening member 20. This arrangement is shown best in the partial cross-sectional view of FIG. 4. Note particularly the manner in which the entire surface area of the base 2 is now open and exposed to the user, because the upper panels 5,6 are out of the way and folded along the sides of the open bag. Because ofthe stiffness of stiffening member 20, the entire bag retains its open shape, and helps to keep the folded side panels 3,4 snugly folded against the bag.

Although not specifically required, it has been found that there is a preferred relationship between the location of the ends of the zipper 17 and the folding line 30 of the side panels 3,4. In particular, the zipper 17 includes terminal ends 41,42 and the first stiffening member 20 includes an upper edge 45, and the height H1 between the base 2 and the terminal ends 41,42 is preferably less than or equal to the height H2 of the upper edge 45 of the first stiffening member 20. If the height H1 of the terminal ends 41,42 of zipper 17 are significantly higher than the height H2 of the upper edge 45 of first stiffening member 20, then the side panels 3,4 will typically be more difficult to open and fold along the sides of the bag.

Figure 5:
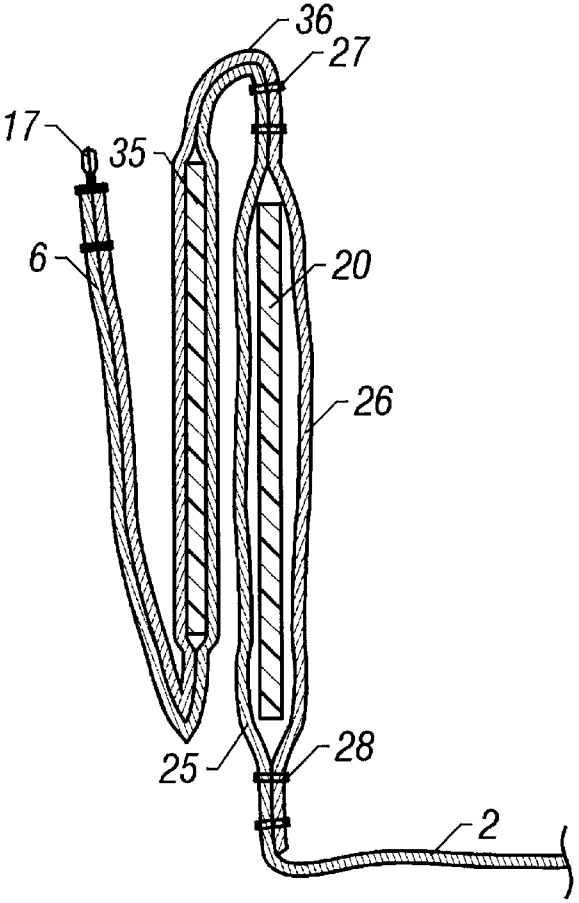
FIG. 5 is a partial cross-sectional view of the embodiment of FIG. 3 depicting the positions of the two stiffening members.

FIG. 3 is essentially identical to the embodiment of FIG. 1, except that the side panels 3,4 each include a second stiffening member 35 attached thereto and positioned above the first stiffening member 20, such that a flexible hinge 36 is established between the first stiffening member 20 and the second stiffening member 35. As in the embodiment of FIG. 1, each of the side panels 3,4 is constructed from two layers of material, but the first stiffening member 20 and the second stiffening member 35 are enclosed independently of one another therebetween by stitching. This arrangement is shown best in the partial cross-sectional view of FIG. 5. The benefit of having two adjacent stiffening members 20,35 in each side panel 3,4 is that the side panels 3,4 can be easily gripped and snapped from a closed position to an open position, and vice versa. The resiliency of the stiffening members 20,35 enables this snapping action to occur, and they further retain the bag in its desired open configuration.

Although the present invention has been described in terms of specific embodiments, it is anticipated that alterations and modifications thereofwill no doubt become apparent to those skilled in the art. It is therefore intended that the following claims be interpreted as covering all such alterations and modifications as fall within the true spirit and scope of the invention.

I claim:

1. A utility bag, comprising:

(a) a flexible base having two opposing outer edges and two upwardly extending end panels;

(b) a pair of opposing flexible side panels attached to and extending upwardly from said opposing outer edges of said base, each of said side panels having a top edge and opposing side edges, and wherein each of said end panels of said base are attached to a lower portion of adjacent said side edges of said opposing side panels;

(c) a pair of flexible upper panels attached to and extending substantially perpendicular from said top edges of said side panels, each of said upper panels including two downwardly extending end panels, wherein each of said downwardly extending end panels is attached to said end panel of said base and to an upper portion of an adjacent said side edge of said side panels;

(d) flexible closing means cooperating between said upper panels and extending between said end panels of said base for closing and opening said bag;

wherein each of said side panels includes a first stiffening member and a second stiffening member attached thereto, wherein said second stiffening member is positioned above said first stiffening member, such that a flexible hinge is established between said first and second stiffening members; and (f) wherein said second stiffening includes an upper edge and wherein said first stiffening member includes a lower edge, and wherein said upper edge of said second stiffening member is adjacent to said lower edge of said first stiffening member when said bag is in a fully open configuration.

2. The utility bag of claim 1, wherein said bag includes at least one handle.

3. The utility bag of claim 1, wherein said closing means comprises a zipper.

4. The utility bag of claim 1, wherein at least one of said side panels is constructed from two layers of material, and wherein said first stiffening member is enclosed therebetween.

5. The utility bag of claim 1, wherein each of said side panels is constructed from two layers of material, and wherein said first stiffening member and said second stiffening member are enclosed independently of one another therebetween.

6. The utility bag of claim 1, wherein said bag is constructed from a synthetic fabric.

7. The utility bag of claim 1, wherein said first stiffening member is constructed from a plastic sheet having a stiffniess sufficient to prevent collapse of said side panels between said side edges.

8. The utility bag of claim 1, wherein said bag is held in an open configuration when each of said side panels are folded over itself along a line adjacent to an upper edge of said first stiffening member.

* * * * *